United States Patent [19]

Dünner

[11] Patent Number: 4,525,012

[45] Date of Patent: Jun. 25, 1985

[54] LOCKING APPARATUS FOR DRAWERS AND THE LIKE

[75] Inventor: Max Dünner, Erlen, Switzerland

[73] Assignee: Lista AG, Switzerland

[21] Appl. No.: 491,288

[22] Filed: May 3, 1983

[30] Foreign Application Priority Data

May 12, 1982 [CH] Switzerland ..... 2966/82

[51] Int. Cl.[3] ..... A47B 88/04

[52] U.S. Cl. ..... 312/222; 292/174; 292/227; 312/333

[58] Field of Search ..... 312/107.5, 215, 218, 312/222, 333, 330, 348; 292/124, 127, 224, 227, 170, 174; 70/85, 86

[56] References Cited

U.S. PATENT DOCUMENTS

| | | | |
|---|---|---|---|
| 294,901 | 3/1884 | Morris | 70/86 |
| 681,155 | 8/1901 | Tobey | 312/218 X |
| 2,209,886 | 7/1940 | Hill | 292/297 |
| 2,981,584 | 4/1961 | Friend | 312/341 R |
| 3,109,686 | 11/1963 | Watts et al. | 312/215 |
| 3,357,762 | 12/1967 | Forsyth | 312/215 |
| 4,033,157 | 7/1977 | Williams | 312/218 X |

FOREIGN PATENT DOCUMENTS

| | | |
|---|---|---|
| 3002408 | 8/1980 | Fed. Rep. of Germany . |
| 11686 | of 1913 | United Kingdom . |

*Primary Examiner*—Francis K. Zugel
*Assistant Examiner*—Joseph Fall
*Attorney, Agent, or Firm*—Roylance, Abrams, Berdo & Goodman

[57] ABSTRACT

An apparatus for locking drawers and the like has a longitudinally guided operating rod for moving a ram mounted in the rear area of the drawer. A sloping surface of the ram projects into a bore of a pivotable lever and pivots it out of a fixed recess, permitting movement of the drawer. The ram is retracted by a spring so that the lever is urged by a torsion spring engages the recess to lock the drawer in the closed position on some other position where a recess is provided. The rod extends through the drawer front.

17 Claims, 4 Drawing Figures

FIG. 1
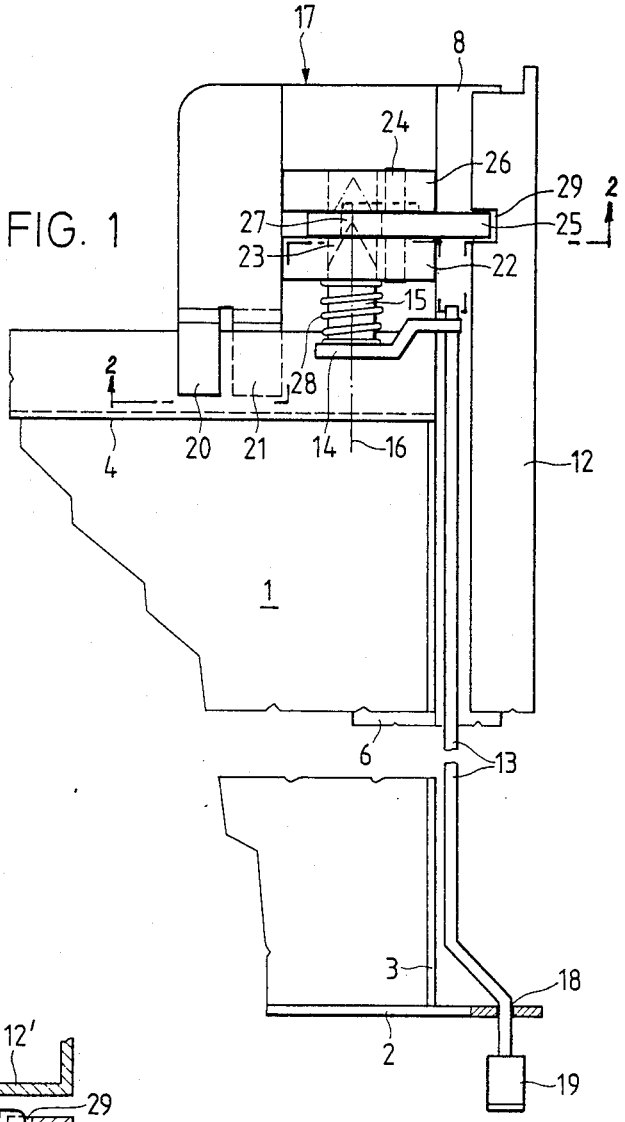
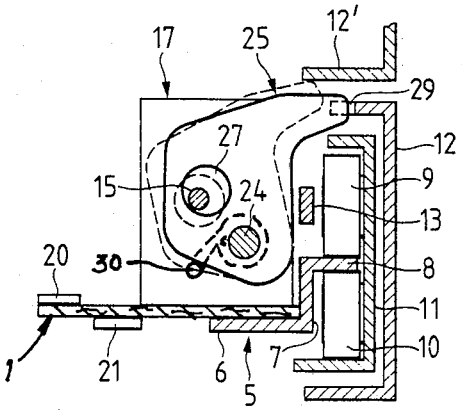
FIG. 2

LOCKING APPARATUS FOR DRAWERS AND THE LIKE

This invention relates to an apparatus for locking individual pull-out members, such as drawers, rack boards and the like which are mounted and guided by a bearing rail and running rail apparatus in a frame, cupboard or rack.

BACKGROUND OF THE INVENTION

Pull-out members are commonly provided in articles of furniture such as cupboards or cabinets and also in other forms of racks or frames, the members being drawers, rack or shelf boards which can be pulled out of the housing for the purpose of inserting or removing objects, or to provide a temporary work surface. The most common pull-out members are removable drawers and rack boards, but such pull-out members can be constructed in various ways. It is known to provide pull-out members with a single pull-out in which is attached a Z-shaped bearing rail on either side of the pull-out member, with one leg of the rail attached to the bottom of the pull-out member, a central web along the side of the pull-out member and a third, free leg projecting into a U-shaped running rail, the free leg being mounted therein in a withdrawal manner on rollers.

While, with single pull-out members, the drawer cannot be completely removed from the housing or rack, it is possible to do so with full pull-out. On both sides of the pull-out member, a Z-shaped bearing rail is fixed in the same fashion as for single pull-out and is mounted by means of rollers in a U-shaped pull-out rail. However, unlike the case of single pull-out, the pull-out rail is not fixed to the cupboard, housing or rack but rather, to permit full pull-out, is mounted in a U-shaped running rail which is attached to the housing, the mounting again being by means of rollers. Both the single pull-out and full pull-out require certain installation widths on either side of the pull-out members and the frame or cupboard becomes larger by this amount. For this reason, the front panel of the drawer or the like projects beyong the two drawer side walls by the amount of the installation widths for either kind of installation.

In racks, cabinets and cupboards with superimposed pull-out members, it is desirable to be able to individually lock the pull-out members. In a known construction, shown in German OS No. 3,002,408, a locking member is attached to the front wall of a pull-out drawer and projects laterally above the front wall and, in the closed position, an operating portion of the lever engages in a vertical slot on the rack or cupboard. This solution makes it possible to arrange drawers having various heights in a random arrangement without it being necessary to make any fundamental modifications with respect to the individual locking system because the locking member can engage in the vertical slot at any height. Although the known solution functions very well, it must be remembered that an additional, although relatively small amount, of material is required during the shaping of the vertical slot for receiving the locking member.

BRIEF SUMMARY OF THE INVENTION

An object of the present invention is to provide a structure for locking individual pull-out members such that they can be locked without requiring additional material or manufacturing steps.

Briefly described, the invention includes an apparatus for locking individual pull-out members such as drawers and rack boards of the type mounted and guided by means including a bearing rail in a running rail attached to a housing wherein the pull-out member carries a locking member movably mounted for movement in a direction perpendicular to the direction of movement of the pull-out member and wherein the housing has means defining a recess to receive the locking member, wherein the improvement comprises means adjacent the back of said pull-out member for movably supporting said locking member for movement between first and second positions in and out of said recess; operating rod means longitudinally movable for operating said locking member between said first and second positions; and guide means for supporting and guiding said rod means along a side of and beyond the front of said pull-out member.

As will be seen, the objective is achieved in that the locking member is movably mounted in the vicinity of the back of the pull-out member and is operable by means of an operating rod guided longitudinally along the pull-out member and through the front thereof.

BRIEF DESCRIPTION OF THE DRAWINGS

In order that the manner in which the foregoing and other objects are attained in accordance with the invention can be understood in detail, a particularly advantageous embodiment thereof will be described with reference to the accompanying drawings, which form a part of this specification, and wherein:

FIG. 1 is a partial top plan view of a drawer having a locking apparatus in accordance with the present invention;

FIG. 2 is a partial front elevation, in section, along line 2—2 of FIG. 1;

DETAILED DESCRIPTION OF PREFERRED EMBODIMENTS

Figure 3:
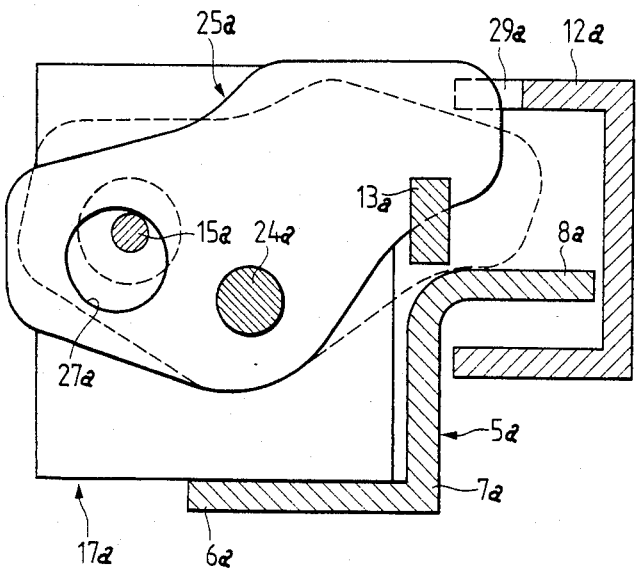
FIG. 3 is a view similar to FIG. 2 of a further embodiment of an apparatus in accordance with the invention.

As will be seen from the following discussion, the invention is based on the concept that a locking device should be constructed in such a way that it requires no modification to the rail parts and rollers of either a single or full pull-out mounting system of the pull-out member to be locked. A structure in accordance with these principles is shown in FIGS. 1 and 2.

These figures show a portion of a pull-out drawer which has a bottom 1, a front wall 2, a side wall 3 and a rear wall 4. Front wall 2 projects laterally beyond the side walls 3 and covers the rails and rollers of a full pull-out suspension for the drawer which is shown in more detail in FIG. 2. On either side of the drawer bottom 1 is fixed a Z-shaped bearing rail indicated generally at 5 having a first leg 6 attached to the bottom of drawer bottom 1, a web connected to leg 6 and extending along side wall 3 and a further leg 8 which extends between rollers 9 and 10 of the mounting system, leg 8 being guided and displaceably supported by the rollers, the rollers themselves being rotatably mounted in a pull-out rail 11. In turn, pull-out rail 11 is mounted by rollers in a conventional fashion, which is not shown in the figures for simplicity, in a U-shaped running rail 12. Rail 12 is fixedly attached to the wall of a rack, cabinet or cupboard, not shown.

FIG. 2 also shows an arrangement in which the presence of an additional running rail 12' is suggested above rail 12. If the pull-out member such as a drawer is constructed with the smallest possible height, rails 12, 12' of the superimposed drawers are positioned directly above one another as illustrated in FIG. 2.

Laterally outside of side wall 3 is guided an operating rod means including a longitudinally extending rod 13 which extends beyond the rear wall 4 of the drawer. Behind wall 4 an arm 14 extends laterally inwardly across the back of the drawer and is fixedly attached to rod 13, the distal end of the arm being attached to a ram 15. In the illustrated embodiment ram 15 is constructed as a cylindrical pin having a conical tapered end, the longitudinal axis 16 of the pin extending parallel with the longitudinal direction of rod 13. Operating rod 13 and ram 15 are displaceably guided for axial movement in a support 17 and in a recess 18 through front wall 2, the rod being offset or bent in the vicinity of wall 2 and provided at the front distal end with an operating handle 19. Support 17 is connected by means of holding lugs 20 and 21 to the rear edge of the drawer. Support 17 has a guide wall 22 with an opening 23 in which ram 15 is guided. A pivotable lever 25 is pivotably mounted in guide wall 22 by means of a spindle 24 which is, in turn, mounted in a further guide wall 26 and is axially secured in a conventional manner.

As will be seen in FIG. 2, the tapered end of ram 15 projects into a bore 27 in such a way that pivotable lever 25 assumes the position shown in broken lines in FIG. 2 when bore 27 in lever 25 is aligned with the longitudinal axis 16 of ram 15. This is the case if ram 15 is moved by operating rod 13 into the broken line position counter to the action of a compression coil spring 28 which surrounds ram 15 and acts between arm 14 and the face of wall 22. In this position of ram 15, lever 25 pivots out of a recess 29 which is provided in one leg of running rail 12. In that condition, the drawer is no longer locked and can be moved.

When operating handle 19 is released, spring 28 presses ram 15 and, consequently, also operating rod 13, into the continuous line position of FIG. 1 so that bore 27 in lever 25 is freed and can be pivoted in the direction of running rail 12. Lever 25 is urged toward the recess by a torsion spring 30 which can be fixedly attached to spindle 24 and act against the underside of lever 25. When the drawer is moved such that the lever approaches the vicinity of recess 29, the lever snaps into the recess again and the drawer is locked. Appropriately, at least one recess 29 is provided for locking the drawer in the closed position. However, it is also quite possible to provide additional recesses 29, longitudinally spaced along rail 12, for securing the drawer in one or more predetermined pull-out positions. If the drawer is to be moved, it is then necessary to operate rod 13 to again swing lever 25 out of the engaged recess.

It is important that lever 25 with its support 17 can be arranged in the rear area of the drawer. This permits the drawer to be secured in one or more partially extracted positions. Nevertheless, operating handle 19 can be positioned in a readily accessible manner at the front of the pull-out member, such as the drawer shown in FIGS. 1 and 2, because rod 13 can be guided above bearing rail 5 without requiring any additional space.

Figure 4:
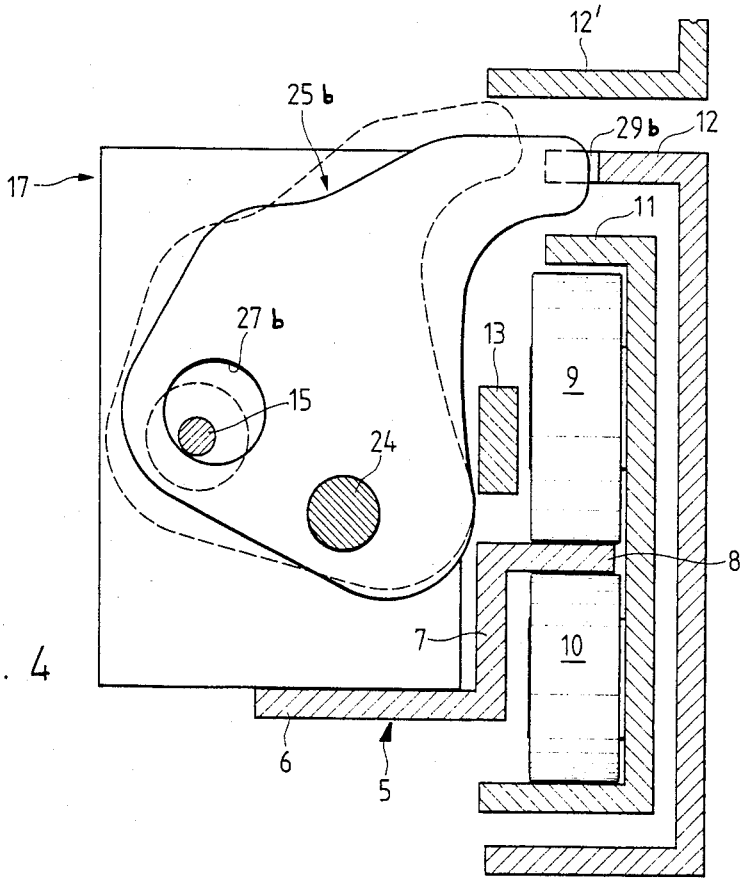
FIG. 4 is a view similar to FIG. 2 of a still further embodiment of an apparatus in accordance with the invention.

Other space conditions are shown in the embodiments of 3 and 4 which differ slightly for single pull-out and full pull-out. As will be seen, the pivotable lever must have a shape adapted to the particular space conditions. FIGS. 3 and 4 show these conditions on a somewhat enlarged scale. In the case of the single pull-out shown in FIG. 3, lever **25*a* is pivoted out of recess 29*a* by a downward movement. The tapered end of ram 15*a* is located in the apex area of bore 27*a* in rocking lever 25*a*. If operating rod 13 is moved rearwardly, the lever is pivoted downwardly out of recess 29*a* as illustrated in the broken lines in FIG. 3**.

In the case of the full pull-out embodiment shown in FIG. 4, the rocking lever **25*b* is formed such that the tapered end of ram 15 is in the lower region of bore 27*b* in the locking position. If the ram 15 is moved rearwardly by operating rod 13, lever 25*b* is pivoted upwardly out of recess 29*b* as illustrated by the broken lines in FIG. 4. As will be apparent from both of FIGS. 3 and 4, there is sufficient space for guiding the operating rod 13 above the webs 7*a*, 8*a* or 7 and 8 of bearing rail 5 or 5*a***.

As a result of the above described locking device, it is possible to arrange the apparatus independently of the position of the pull-out member in the cabinet or other housing structure. The position of the locking device on the pull-out member can always be predetermined because the running rail 12 is always arranged in the same way with respect to the pull-out member regardless of whether it is single or full suspension.

Bore 27, serving as a guide for operating rod 13, can also be constructed in other ways such as, for example, a rectangular hole with ram 15 then taking the form of a flat strip having an inclined surface. In the simplest construction, it is merely necessary to have a supporting surface on which the sloping surface of operating rod 13 can be supported during the pivoting of lever 25. No other problems are encountered when operating rod 13 is fitted differently to the front of the pull-out member as compared with the specific configuration shown in FIG. 1, i.e., whether or not it has a bend, a holding plate, a hand lever or other configurations.

While certain advantageous embodiments have been chosen to illustrate the invention, it will be understood by those skilled in the art that various changes and modifications can be made therein without departing from the scope of the invention as defined in the appended claims.

What is claimed is:

1. An apparatus for locking individual pull-out members, such as drawers and rack boards of the type mounted and guided by a bearing rail located in a running rail attached to a housing, comprising:

a locking member including a pivotable lever having a guide opening therethrough;

means defining a recess in the housing to receive said locking member;

support means, adjacent the back of said pull-out member, for movably supporting said locking member on said pull-out member for movement relative to said pull-out member in a direction perpendicular to the direction of pull-out member movement between a first position in said recess and a second position out of said recess, said support means including a pivot fixedly attached to the rear of the pull-out member;

operating rod means longitudinally movable for operating said locking member between said first and second positions, said operating rod means including an axially movable ram member having a cam surface inclined relative to the movement axis thereof, said cam surface being positioned adjacent an edge of said guide opening such that axial movement of said rod means and said ram member relative to said lever moves said lever between said second and first positions with said ram member being in said guide opening when said locking member is in said recess and being out of said guide opening when said locking member is out of said recess; and guide means for supporting and guiding said rod means along a side of and beyond the front of said pull-out member.

2. An apparatus according to claim 1 wherein said ram member comprises a cylindrical pin; and said cam surface is conical and is located at the distal end of said cylindrical pin.

3. An apparatus according to claim 1 wherein said operating rod means includes a rod and an arm extending from said rod across the rear of the pull-out member, said ram member being supported at an inner end of said arm and extending parallel with said rod.

4. An apparatus according to claim 1 wherein said rod means includes a spring urging said ram member to the position in which said lever can enter said recess.

5. An apparatus according to claim 4 and comprising a torsion spring urging said lever toward said recess.

6. An apparatus according to claim 1 wherein said operating rod means includes a rod and an arm extending from said rod across the rear of the pull-out member, said ram member being supported at the inner end of said arm and extending parallel with said rod.

7. An apparatus according to claim 1 wherein said bearing rail comprises a central horizontal web; and said rod means extends above said central web.

8. An apparatus according to claim 1 wherein said recess comprises a notch in said running rail, said notch being positioned to receive said locking member when the pull-out member is in the fully closed position.

9. An apparatus according to claim 1 wherein said support means pivotally attaches said locking member to said pull-out member for movement about an axis parallel to pull-out member movement.

10. A pull-out member, such as a drawer or rack board, comprising:

mounting and guiding means including a bearing rail located in a running rail attached to a housing;

a locking member including a pivotable lever having a guide opening therethrough;

means defining a recess in the housing to receive said locking member;

support means, adjacent the back of said pull-out member, for movably supporting said locking member on said pull-out member for movement relative to said pull-out member in a direction perpendicular to the direction of pull-out member movement between a first position in said recess and a second position out of said recess, said support means including a pivot fixedly attached to the rear of said pull-out member;

operating rod means longitudinally movable for operating said locking member between said first and second positions, said operating rod means including an axially moveable ram member having a cam surface inclined relative to the movement axis thereof, said cam surface being positioned adjacent an edge of said guide opening such that axial movement of said rod means and said ram member relative to said lever moves said lever between said second and first positions, said ram member including a cylindrical pin, said cam surface being conical and located at the distal end of said cylindrical pin; and guide means for supporting and guiding said rod means along a side of and beyond a front of said pull-out member.

11. A pull-out member according to claim 10 wherein said operating rod means includes a rod and an arm extending from said rod across the rear of said pull-out member, said ram member being supported at the inner end of said arm and extending parallel with said rod.

12. A pull-out member according to claim 10 wherein said rod means includes a spring urging said ram member to the position in which said lever can enter said recess.

13. A pull-out member according to claim 12 wherein a torsion spring urges said lever toward said recess.

14. A pull-out member according to claim 10 wherein said operating rod means includes a rod and an arm extending from said rod across the rear of said pull-out member, said ram member being supported at an inner end of said arm and extending parallel with said rod.

15. An apparatus according to claim 10 wherein said bearing rail comprises a central horizontal web; and said rod means extends above said central web.

16. A pull-out member according to claim 10 wherein said recess comprises a notch in said running rail, said notch being positioned to receive said locking member when said pull-out member is in the fully closed position.

17. A pull-out member according to claim 10 wherein said support means pivotally attaches said locking member to said pull-out member for movement about an axis parallel to pull-out member movement.

* * * * *